US007207393B2

(12) United States Patent
Clark, Jr. et al.

(10) Patent No.: US 7,207,393 B2
(45) Date of Patent: Apr. 24, 2007

(54) STEPPED DRIVE SHAFT FOR A POWER TOOL

(75) Inventors: Weldon H. Clark, Jr., Liberty, SC (US); Elton Lee Watson, Greenville, SC (US)

(73) Assignee: Eastway Fair Company Ltd., Tortola (VG)

( * ) Notice: Subject to any disclaimer, the term of this patent is extended or adjusted under 35 U.S.C. 154(b) by 0 days.

(21) Appl. No.: 11/001,834

(22) Filed: Dec. 2, 2004

(65) Prior Publication Data

US 2006/0118316 A1 Jun. 8, 2006

(51) Int. Cl.
*B25B 23/16* (2006.01)
*B25G 1/00* (2006.01)

(52) U.S. Cl. ..... 173/90; 173/93; 173/130

(58) Field of Classification Search ..... 173/90, 173/93, 104, 128, 130, 131, 132
See application file for complete search history.

(56) References Cited

U.S. PATENT DOCUMENTS

| | | | | |
|---|---|---|---|---|
| 2,525,695 | A | 10/1950 | Lombard | |
| 2,801,718 | A | 8/1957 | Kaman | |
| 2,954,994 | A | 10/1960 | Beers | |
| 3,414,065 | A | 12/1968 | Falter | |
| 3,533,479 | A | 10/1970 | Madsen | |
| 3,610,344 | A | 10/1971 | Schoeps et al. | |
| 3,651,720 | A * | 3/1972 | Indyk | 81/124.5 |
| 3,734,515 | A * | 5/1973 | Dudek | 279/144 |
| 3,752,214 | A | 8/1973 | Pertot | |
| 4,277,990 | A * | 7/1981 | Hall | 81/63 |
| 4,907,476 | A * | 3/1990 | Singleton | 81/57.29 |
| 4,991,470 | A * | 2/1991 | Singleton | 81/177.7 |
| 4,991,472 | A | 2/1991 | Hollingsworth | |
| 5,038,869 | A | 8/1991 | Olson | |
| 5,050,467 | A | 9/1991 | Brown et al. | |
| 5,152,197 | A * | 10/1992 | Szymber et al. | 81/59.1 |
| 5,485,769 | A * | 1/1996 | Olson et al. | 81/177.85 |
| 5,595,099 | A | 1/1997 | Pusateri | |
| 6,038,946 | A * | 3/2000 | Jackson et al. | 81/177.2 |
| 6,070,674 | A * | 6/2000 | Williamson et al. | 173/1 |
| 6,367,356 | B1 * | 4/2002 | Stepp | 81/177.2 |
| 6,457,535 | B1 | 10/2002 | Tanaka | |
| 6,748,828 | B2 * | 6/2004 | Bollinger | 81/177.2 |
| 6,938,526 | B2 * | 9/2005 | Milbourne et al. | 81/466 |
| 7,114,418 | B1 * | 10/2006 | Allen | 81/439 |

* cited by examiner

*Primary Examiner*—Brian Nash
(74) *Attorney, Agent, or Firm*—Brinks Hofer Gilson & Lione

(57) ABSTRACT

A shaft comprises an input portion and a tang. The tang has a first section, a second section, and a radial bore. The second section is disposed between the first section and the input portion along an axis. A radial cross section of the first section is less than a radial cross section of the second section. The radial bore is disposed on the first section.

21 Claims, 2 Drawing Sheets

STEPPED DRIVE SHAFT FOR A POWER TOOL

TECHNICAL FIELD

The present invention relates to shafts that transfer torque through a shaped connection, and more particularly to anvil shafts in rotary power tools such as impact drivers.

BACKGROUND

Rotary impact power tools are used to tighten or loosen fastening devices such as bolts, nuts, screws, etc. Rotary impact power tools have been developed that use a pneumatic or electric motor to drive a hammer which rotationally impacts an anvil. These anvils typically have a tang portion with a square cross section and are coupled with an output such as a drive socket. The tang portion has a transverse hole on one of the faces to house a spring-loaded detent pin. The detent pin releasably engages a corresponding recess in the drive socket.

Prior art anvils used in impact drivers are subject to fatigue failures. Fatigue is a phenomenon that leads to fracture in a load-bearing member under repeated or fluctuating stresses, even though those stresses may be substantially less than the tensile strength of the member. Fatigue fractures generally start at a point of geometric discontinuity or stress concentration and grow incrementally until a critical size is reached. It has been found that a stress concentration is created at the transverse hole on the face of the anvil tang in prior art anvil designs. This stress concentration at the transverse hole severely weakens the anvil tang, increasing its risk of fatigue failure. Further, when the anvil tang is subject to a fatigue failure, the failure can occur in a catastrophic manner. This potentially results in propelling the socket and broken portion of the anvil at high speed, which may injure an operator or bystander.

For the foregoing reasons, there is a need for an anvil for an impact driver that reduces the stress concentration and fatigue failure at the tang.

BRIEF SUMMARY

Accordingly, embodiments of the present invention provide a new and improved anvil for an impact driver. In one embodiment, the tang portion of the anvil is stepped, with a smaller first tang section transitioning to a larger second tang section. The transverse hole is placed in the smaller first tang section, while the larger second tang section engages the drive socket. This anvil design shifts the stress from the transverse hole to the solid larger tang section, thereby reducing the number of fatigue failures of rotary impact drivers.

According to a first aspect of the invention, a shaft comprises an input portion and a tang. The tang has a first section, a second section, and a bore. The second section is disposed between the first section and the input portion along an axis. A radial cross section of the first section is less than a radial cross section of the second section. The radial bore is disposed on the first section.

According to a second aspect of the invention, an anvil comprises an anvil portion and a tang. The tang has a first section, a second section, and a bore. The second section is disposed between the first section and the anvil portion along an axis. A radial cross section of the first section is less than a radial cross section of the second section. The radial bore is disposed on the first section.

According to a third aspect of the invention, a hand held power tool may include a housing, a motor, a power source, a cam shaft, a hammer, and an anvil. The motor is disposed in the housing. The power source energizes the motor. The cam shaft is driven by the motor and the hammer is driven by the cam shaft. The anvil comprises an anvil portion and a tang. The tang has a first section, a second section, and a radial bore. The second section is disposed between the first section and the anvil portion along an axis. A radial cross section of the first section is less than a radial cross section of the second section. The radial bore is disposed on the first section.

A fourth aspect of the invention is an impact driver and may include a housing, a motor, a power source, a transmission, a cam shaft, a hammer, an anvil, and an output. The motor is disposed in the housing. The power source energizes the motor. The transmission is driven by the motor. The cam shaft is coupled with the transmission. The hammer is axially aligned with the cam shaft and is driven rotationally and axially by the cam shaft. The anvil comprises an anvil portion and a tang. The tang has a first section, a second section, and a radial bore. The second section is disposed between the first section and the anvil portion along an axis. A radial cross section of the first section is less than a radial cross section of the second section. The radial bore is disposed on the first section. An output is coupled with the tang.

DETAILED DESCRIPTION OF THE DRAWINGS AND THE PRESENTLY PREFERRED EMBODIMENTS

Figure 1:
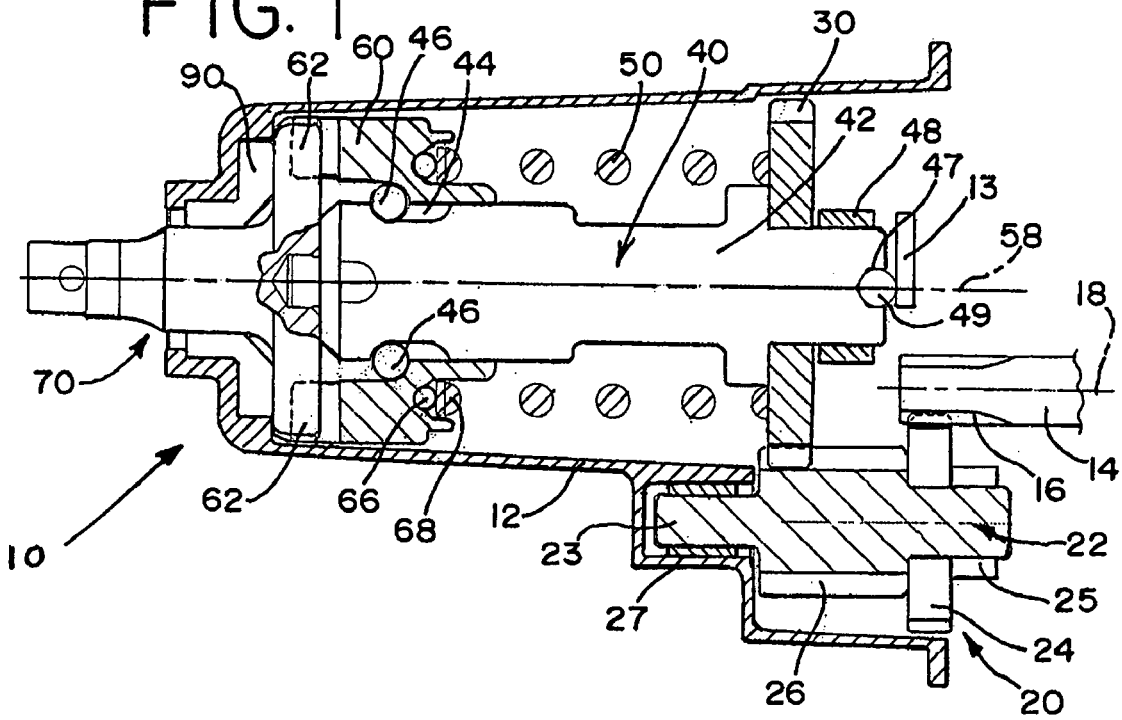
FIG. 1 shows a cross section view of the front portion of an exemplary impact driver that incorporates the anvil of the present invention.

Referring now to FIG. 1, the front nose portion of an impact driver 10 is shown with a clam shell housing 12. The impact driver 10 includes a motor (not shown), a transmission, a cam 40, a hammer 60, and the anvil 70 of the present invention. The motor is preferably an electric motor and is energized by a power source such as a rechargeable battery (not shown) or AC line current. Alternately, the motor can be a pneumatic motor, powered by a pressurized air or hydraulic line, or a hand-operated or gear-driven device. The motor has an armature shaft 14 with a pinion end 16. Shaft 14 rotates about motor axis 18.

Shaft 14 may be coupled with a transmission to adjust the output torque or speed. As best seen in FIG. 1, the transmission comprises a gear assembly 20 made up of coupled gears. The gear assembly consists of a double gear 22, made up of a smaller first gear 24 and a larger second gear 26, and a third gear 30. Double gear 22 may be integrally formed, with first gear 24 and second gear 26 concentrically aligned, sharing an axis of rotation, and rotating at the same angular velocity, but operating in different planes. Double gear 22 rotates about an integral first axle 23 rotationally supported by a first bearing 25 and a second bearing 27 mounted in housing 12. First and second bearings 25, 27 are preferably sleeve bearings, although other types of bearings may be used. Third gear 30 is mounted and rotates about a cam shaft 42 of cam 40. Alternately, third gear 30 may be integrally formed with cam shaft 42. The pinion end 16 of armature shaft 14 directly engages the first gear 24 of double gear 22, which in turn rotates second gear 26, which engages and rotates third gear 30. Because third gear 30 is rotationally fixed to cam shaft 42, cam shaft 42 rotates. The gear assembly described above preferably uses a series of coupled spur gears operating in parallel planes. However, the gears may also operate in intersecting or skew planes, where bevel, helical, hypoid, or other suitable gears would then be used to couple shaft 14 to cam shaft 42. Alternately, any transmission may be used to change the motor output torque and speed, such as a sun and planet gear system. In addition, a stall-type mechanism (not shown) may be coupled with the transmission to allow the motor to run until it stalls at a desired output torque.

The third gear 30 is rotatably coupled with cam 40. The cam 40 consists of a cam shaft 42, at least one camming ball 46 located in integrally formed camming grooves 44 on the cam shaft 42, and an impact spring 50. A third bearing 48 journalled on cam shaft 42 and a ball 49 supported by a hardened steel plate 13 of housing 12 and seated within an axial recess 47 in cam shaft 42 provide rotational support for cam shaft 42 at one end. The other end of cam shaft 42, opposite the third gear 30, rotates within an axial recess 73 in anvil 70 to also provide support. Cam shaft 42 rotates about output axis 58. The impact spring 50 is preferably a coil spring, with one end supported by a radial face of third gear 30. Alternately, impact spring 50 may be supported by an integrally formed radially extending flange (not shown) on cam shaft 42. The other end of spring 50 axially biases a rotary hammer 60.

The hammer 60 rotates about cam shaft 42 and is axially slidable relative to cam shaft 42 due to spring 50. The cam forces the hammer 60 axially against the resistance of impact spring 50 during each revolution or portion of a revolution of the hammer 60 so as to bring the radial sides of a pair of hammer lugs 62 that project axially from a forward wall of the hammer 60 into rotary impact with the radial sides of a pair of lugs 72 that project from the integrated anvil-gear 70.

The hammer 60 also has an axial channel (not shown) where a plurality of balls 66 are located. The axial channel is preferably sized so that eighteen stainless steel impact balls 66 of 3.50 mm diameter can be positioned within it, although it may be sized so that other sizes or numbers of balls 66 may be used. A washer 68 is positioned on the balls 66 in the axial channel. Axial or rotational loads on the spring 50 are taken up the roller bearing formed by washer 68 and balls 66.

Figure 4:
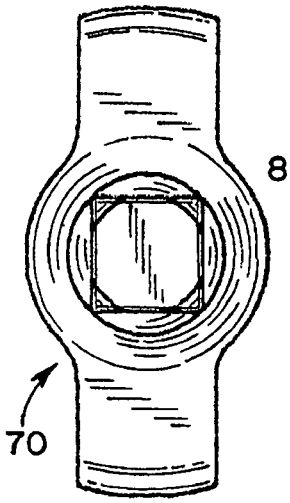
FIG. 4 is an end view of the anvil of the present invention, showing the tang.
Figure 3:
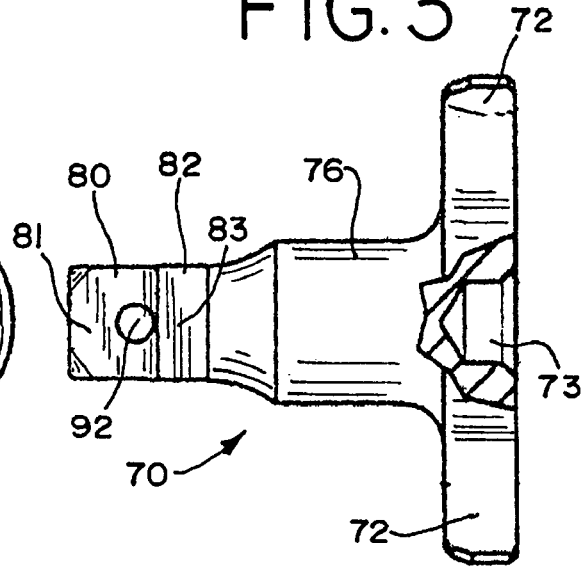
FIG. 3 is a side view of the anvil of the present invention, with a partial cross section view taken at the anvil end.
Figure 5:
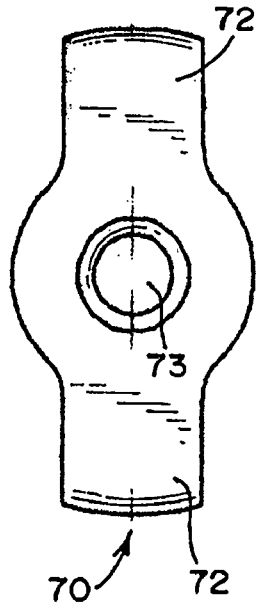
FIG. 5 is an end view of the anvil of the present invention, showing the anvil.
Figure 6:
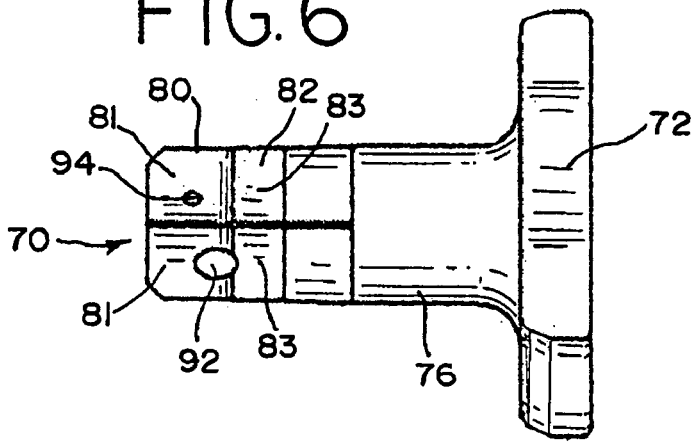
FIG. 6 is another side view of the anvil of the present invention.

As shown in FIGS. 2–7, the anvil 70 is a one-piece design consisting of an anvil portion 74 with radially projecting lugs 72, a torque transfer section 76, and a male tang 78. Torque transfer section 76 preferably has a circular cross section when viewed in a plane normal to the axis of rotation, as seen in FIG. 4, although other shapes may be used. Male tang 78 preferably has a square cross section when it is viewed in a plane normal to the axis of rotation, as seen in FIG. 4, although other cross-sectional shapes may be used. The male tang 78 is also stepped, with a smaller first end section 80 that transitions to a larger second section 82. Second section 82 transitions to the torque transfer section 76, which transitions to the anvil portion 74. Male tang 78 has two sets of four flats, with four flats 81 formed on first section 80 and four flats 83 formed on second section 82. The transverse distance between opposite parallel flats 83 corresponds to the desired output size, for example, quarter-inch, three-eighths inch, half-inch, three-quarters inch, one inch, etc. For a half-inch drive socket, male tang 78 may be sized with a transverse distance of 0.499 to 0.502 inches for second section 82, and a transverse distance of 0.484 to 0.489 inches for first section 80.

Figure 2:
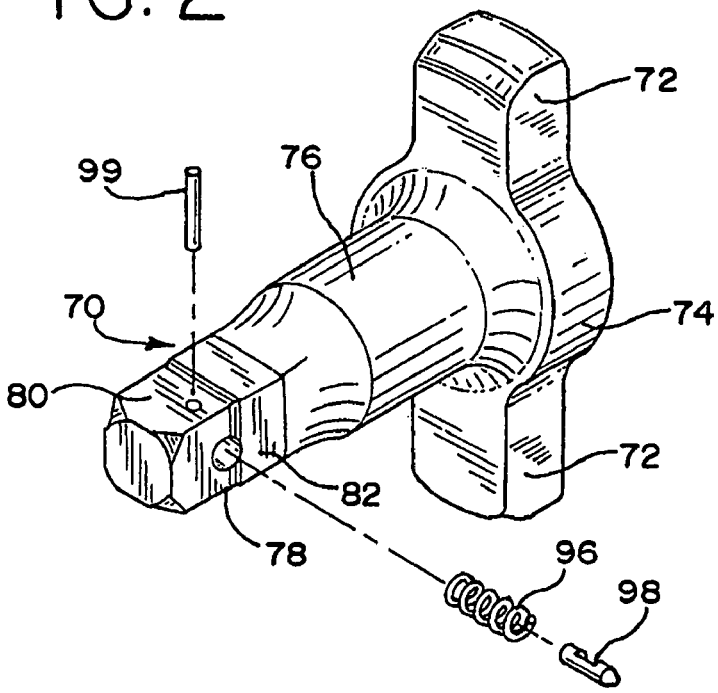
FIG. 2 shows an exploded perspective view of the anvil of the present invention.
Figure 7:
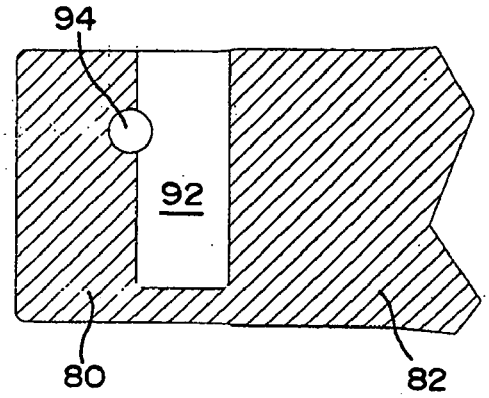
FIG. 7 is a cross section view of the anvil, showing the radial bore on the first section of the tang.

Male tang 78 is preferably sized to be received in a female receptacle of an output (not shown) of like configuration and size. Such outputs may include a drive socket, an adapter, etc. Second section 82, being larger than first section 80, transfers the impact torque from the motor via the hammer 60 to the output, providing for a rotational lock. A retaining means such as a spring-loaded detent is disposed on first section 80 to engage a corresponding recess or groove in the female receptacle of an output and provide an axial lock. The detent may include a coil spring 96 biasing a slotted pin 98, as shown in FIG. 2. The detent is preferably located in a transverse bore 92 that is drilled into a flat 81 on first section 80. Preferably, transverse bore 92 does not intersect flat 83 on second section 82. A retaining pin 99 secures the slotted pin 98 and spring 96 in transverse bore 92 and is inserted into a second transverse bore 94 on flat 81, adjacent to the flat with transverse bore 92. For a half-inch drive socket, transverse bore 92 may be drilled with a 0.165 inch hole that extends 0.424 inches deep. In addition, second transverse hole 94 may be drilled as a 0.078 inch through hole that partially intersects transverse bore 92, as seen in FIG. 7.

FIG. 2 depicts the lugs 72 aligned with the square formed by male tang 78, although the angular alignment may be at any angle. Further, while two lugs 72 are shown, other numbers may also be used. In such a case, the hammer lugs 62 are generally counter-balanced to offset any asymmetry. The anvil 70 is integrally formed, preferably machined from Grade SNCM 220 Steel bar stock, with an oil dip finish to prevent rust.

As shown in FIG. 1, the anvil 70 is supported for rotation by a sleeve bearing 90. Sleeve bearing 90 is placed over torque transfer section 76. Sleeve bearing 90 is preferably made from sintered copper and iron with a Metal Powder Industries Federation (MPIF) designation of FC-2008 and a K Factor (indicating radial crushing strength) of K46, although other formulations or different types of bearings may be used. Sleeve bearing 90 is also preferably vacuum impregnated with a lubricant such as MOBIL SHC 626 at 17% by volume, although other lubricants and impregnation volumes may be used.

In operation, as the motor drives the armature shaft 14 about motor axis 18, drive is transmitted through the transmission to the cam shaft 42 about output axis 58. The cam 40 disposed about the cam shaft 42 rotationally and axially displaces hammer 60 along cam shaft 42 to rotationally impact the anvil portion 74 of anvil 70. Torque is transmitted through the anvil by the anvil portion 74 through the torque transfer section 76 into male tang 78. Second section 82 transfers the impact torque to the output, providing for a rotational lock. The detent disposed on first section 80 of male tang 78 provides an axial lock with the output. By reducing the size of first section 80 and by moving transverse bore 92 far from the applied load area, the stress from the impact torque produced by the hammer is evenly distributed throughout the cross-section of second section 82. Without a stress concentration due to the hole to contribute to fatigue failures, the expected operating life of the anvil should be increased.

The present invention is applicable to power driven rotary tools such as impact drivers, angle impact drivers, stall-type angle wrenches, screwdrivers, nutrunners, etc., and provides an anvil that reduces the stress concentration caused by a detent. The anvil reduces a potential failure point in the tang, providing for a more robust transfer of drive torque to the output. While the invention has been described with reference to details of the illustrated embodiment, these details are not intended to limit the scope of the invention as defined in the appended claims. For example, while the invention has been described with reference to an anvil, shafts having other inputs such as gears, keyways, splines, or grooves may also be used. In addition, while the retaining means has been described as it relates to a spring-loaded detent, other retaining means such as a retaining ring may be used. Further, while the anvil has been described with reference to a transverse bore, designs that generate stress concentrations with other shapes, such as grooves, through holes, etc., may also be used. In addition, other anvil or drive means may be used. Also, other shapes and sizes of the male tang and torque transfer section may also be used, such as other polygonal shapes, including hexagons, octagons, etc., or rounded shapes such as circles or ellipses. It is therefore intended that the foregoing detailed description be regarded as illustrative rather than limiting, and that it be understood that it is the following claims, including all equivalents, that are intended to define the spirit and scope of this invention.

We claim:

1. A hand held power tool comprising:

a. a housing;

b. a motor disposed in the housing;

c. a power source that energizes the motor;

d. a cam shaft driven by the motor;

e. a hammer driven by the cam shaft; and f. an anvil comprising:

i. an anvil portion including a plurality of arms extending radially from a rear end of the anvil;

ii. a tang formed at a forward end of the shaft and as a single piece with the anvil portion, the tang having a first section with a first bore and a second section without a bore disposed between the first section and the anvil portion along an axis to form an output portion to substantially eliminate any stress concentration at the output portion and, wherein the first and second sections of the tang each have a square cross section such the a width of the cross section of the first section is less than a width of the cross section of the second section; and iii. a torque transfer section disposed between the anvil portion and the second section along the axis;

g. a sleeve bearing engaging the torque transfer section.

2. The hand held power tool of claim 1, wherein the motor is an electric motor or a pneumatic motor and wherein the power source is a battery, AC line current, hydraulic, or pneumatic pressure.

3. The hand held power tool of claim 1, wherein the anvil has a detent assembly disposed in the first bore.

4. The hand held power tool of claim 3, wherein the detent assembly comprises a spring biasing a pin or ball.

5. The hand held power tool of claim 3, wherein the tang is configured to be received by an output and, wherein the section contact and rotates with the output and wherein the detent assembly axially secures the output.

6. The hand held tool of claim 1, wherein the tang has a second bore disposed on the first section that intersects the first bore.

7. The hand held power tool of claim 6, wherein the anvil has a detent assembly disposed in the first bore, wherein the detent assembly comprises a spring biasing a first pin or ball, and wherein a second pin disposed in the second bore secures the detent assembly in the first bore.

8. The hand held power tool of claim 1, wherein the tang is configured to be received by an output.

9. The hand held power tool of claim 1, wherein the first bore is located only on the first section.

10. The hand held power tool of claim 1, wherein the tang is configured to be received by an output and wherein the second section contacts and rotates with the output and wherein the detent assembly axially secures the output.

11. The hand held power tool of claim 1, wherein the first and second sections have a width of about one-half inch.

12. An impact driver comprising:

a. a housing;

b. a motor disposed in the housing;

c. a power source that energizes the motor;

d. a transmission driven by the motor;

e. a cam shaft coupled with the transmission;

f. a hammer axially aligned with the cam shaft, wherein the hammer is driven rotationally and axially by the cam shaft;

g. an anvil comprising:

i. an anvil portion including a plurality of arms extending radially from a rear end of the anvil;

ii. a tang formed at a forward end of the shaft and as a single piece with the anvil portion, the tang having a first section with a first bore and a second section, without a bore disposed between the first section and the anvil portion along an axis to form an output portion to substantially eliminate any stress concentration at the output portion, wherein the first and the second sections of the tang each have a square cross section such that a width of the cross section of the first section is less than a width of the cross section of the second section; and iii. a torque transfer section disposed between the anvil portion and the second section along the axis;

h. a sleeve bearing engaging the torque transfer section; and wherein the tang is configured to be received by an output.

13. The impact driver of claim 12, wherein the motor is an electric motor or a pneumatic motor and wherein the power source is a battery, AC line current, pneumatic pressure, or hydraulic pressure.

14. The impact driver of claim 12, wherein the anvil has a detent assembly disposed in the first bore.

15. The impact driver of claim 14, wherein the detent assembly comprises a spring biasing a pin or ball.

16. The impact driver of claim 12, wherein the tang has a second bore disposed on the first section that intersects the first bore.

17. The impact driver of claim 16, wherein the anvil has a detent assembly disposed in the first bore, wherein the detent assembly comprises a spring biasing a pin or ball, and wherein a pin disposed in the second bore secures the detent assembly in the first bore.

18. The impact driver of claim 12 wherein the second section contacts and rotates with the output and wherein the detent assembly axially secures the output.

19. The impact driver of claim 12, wherein the first bore is located only on the first section.

20. The impact driver of claim 19, wherein the second section contacts and rotates with the output and wherein the detent assembly axially secures the output.

21. The impact driver of claim 12, wherein the first and second sections have a width of about one-half inch.

* * * * *

UNITED STATES PATENT AND TRADEMARK OFFICE

CERTIFICATE OF CORRECTION

PATENT NO. : 7,207,393 B2
APPLICATION NO. : 11/001834
DATED : April 24, 2007
INVENTOR(S) : Weldon H. Clark, Jr. et al.

It is certified that error appears in the above-identified patent and that said Letters Patent is hereby corrected as shown below:

In the Claims

Column 5, in claim 1, line 50, after "section such" delete "the" and substitute --that-- in its place.

Column 5, in claim 5, line 66, delete "section contact" and substitute --second section contacts-- in its place.

Column 6, in claim 12, line 34, immediately after "bore and a second section" delete "," (comma).

Signed and Sealed this

Thirty-first Day of July, 2007

JON W. DUDAS
*Director of the United States Patent and Trademark Office*